US008011220B2

(12) United States Patent
Brochheuser et al.

(10) Patent No.: US 8,011,220 B2
(45) Date of Patent: Sep. 6, 2011

(54) BACKWARD EXTRUSION PROCESS FOR INNER PROFILES

(75) Inventors: Ulrich Brochheuser, Neunkirchen (DE); Andreas Gehrke, Siegburg (DE)

(73) Assignee: GKN Driveline International GmbH, Lohmar (DE)

( * ) Notice: Subject to any disclaimer, the term of this patent is extended or adjusted under 35 U.S.C. 154(b) by 1077 days.

(21) Appl. No.: 10/562,349

(22) PCT Filed: Jun. 4, 2005

(86) PCT No.: PCT/EP2005/006027

§ 371 (c)(1),
(2), (4) Date: May 4, 2006

(87) PCT Pub. No.: WO2006/018057

PCT Pub. Date: Feb. 23, 2006

(65) Prior Publication Data

US 2006/0213246 A1 Sep. 28, 2006

(30) Foreign Application Priority Data

Aug. 18, 2004 (DE) ..... 10 2004 039 967

(51) Int. Cl.
*B21C 25/04* (2006.01)
*B21C 23/04* (2006.01)
*B21C 37/00* (2006.01)

(52) U.S. Cl. ..... 72/268; 72/264; 72/370.14; 72/370.17

(58) Field of Classification Search ..... 72/268, 72/264, 370.01, 370.14, 370.16, 370.17, 72/370.19, 358, 273.5, 267, 359, 265, 453.01, 72/453.14, 453.18
See application file for complete search history.

(56) References Cited

U.S. PATENT DOCUMENTS

| | | | | |
|---|---|---|---|---|
| 2,344,285 | A * | 3/1944 | Cormode | 72/354.6 |
| 4,142,392 | A | 3/1979 | Ochiai et al. | |
| 4,161,112 | A | 7/1979 | Stump | |
| 4,292,831 | A | 10/1981 | Simon | |
| 4,580,431 | A | 4/1986 | Oku et al. | |
| 4,616,500 | A | 10/1986 | Alexoff | |
| 4,726,211 | A | 2/1988 | Sunaga et al. | |
| 4,785,648 | A * | 11/1988 | Budrean et al. | 72/77 |
| 5,119,662 | A | 6/1992 | Sunaga et al. | |
| 5,522,246 | A | 6/1996 | Simon | |
| 5,606,583 | A | 2/1997 | Verdier et al. | |
| 5,964,117 | A | 10/1999 | Holroyd et al. | |
| 6,038,901 | A | 3/2000 | Stein et al. | |
| 6,134,937 | A | 10/2000 | Lee et al. | |

(Continued)

FOREIGN PATENT DOCUMENTS

CN 1195306 A 10/1998

(Continued)

*Primary Examiner* — Debra Sullivan
(74) *Attorney, Agent, or Firm* — Rader, Fishman & Grauer, PLLC

(57) ABSTRACT

A process of producing an inner profile (18)in a tube or hollow profile (11) includes inserting the tube or hollow profile (11) into a supporting sleeve (12), with a first tube end (19) being axially supported; placing a pressure-loaded annular die 16 on to the other tube end (20); pressing a forming die (15) with an outer profile into the tube or hollow profile (11) from the latter tube end (20) for producing the inner profile (18); allowing a return of the annular die (16) under a pressure load in the opposite direction of that of pressing in the forming die (15).

10 Claims, 1 Drawing Sheet

U.S. PATENT DOCUMENTS

| | | | | |
|---|---|---|---|---|
| 6,758,077 | B2 | 7/2004 | Kaneko et al. | |
| 6,837,091 | B2 | 1/2005 | Brochheuser et al. | |
| 7,114,362 | B2 | 10/2006 | Mitchell et al. | |
| 2002/0092168 | A1 * | 7/2002 | Ilhara et al. | 29/898.043 |

FOREIGN PATENT DOCUMENTS

| | | | |
|---|---|---|---|
| DE | 3016135 | A1 | 10/1981 |
| DE | 35 06 221 | C1 | 7/1986 |
| DE | 35 06 220 | A1 | 8/1986 |
| DE | 3622678 | A1 | 1/1987 |
| DE | 19508798 | A1 | 9/1995 |
| EP | 0663248 | A1 | 7/1995 |
| EP | 1177843 | A2 | 2/2002 |
| FR | 2 272 773 | | 12/1975 |
| GB | 940 467 | | 10/1963 |
| JP | 55156632 | | 5/1980 |
| JP | 57-97651 | | 6/1982 |
| WO | WO 2004/094083 | A2 | 11/2004 |

* cited by examiner

BACKWARD EXTRUSION PROCESS FOR INNER PROFILES

BACKGROUND

The invention relates to a process of producing an inner profile in a tube or hollow profile.

In this process, the tube or hollow profile, prior to being deformed, comprises a substantially uniform wall thickness and is placed into a suitable supporting sleeve and is deformed by pressing in a forming die—whose outer profile corresponds to the inner profile to be produced—starting from one tube end. The material displaced as a result of the production of the profile leads to a backward extrusion of the deformed tube or profile at the tube end inside the supporting sleeve.

When carrying out said prior art process, there exist limits regarding the profile height, i.e. the difference between the smallest cross-section and the greatest cross-section of the forming die in that, with an increasing degree of deformation, the profile filling becomes inadequate. The material no longer fully fills the tool contour of the forming die, which results in an unusable product. In addition, it is possible that, in the running-in region, the portion of the inner profile where the least change in shape occurs is subject to under-filling.

SUMMARY OF THE INVENTION

It is therefore an object of the present invention, to provide an improved process of producing inner profiles, which process ensures an improvement in the degree of filling of a mould and which makes higher profile heights safe for production.

The process of producing an inner profile in a tube or hollow profile inludes: inserting the tube or hollow profile into a supporting sleeve, with a first tube end being axially supported; placing a pressure-loaded annular die on to the other tube end; pressing a forming die with an outer profile into the tube or hollow profile from the latter tube end for producing the inner profile; and allowing the return of the annular die under a pressure load in the opposite direction of that of pressing in the forming die.

A process carried out in this way allows a counter pressure to be built up on the back-flowing, completed tube or hollow profile with an inner profile, which counter pressure forces the material to flow into the full profile cross-section of the forming die and prevents under-filling at the start of the inner profile. The supporting sleeve radially supports the tube or hollow profile, thus preventing a radial expansion. More particularly, the improved inventive process can be carried out as a cold forming process.

In a particularly optimised embodiment of the inventive process, the pressure-loaded return of the annular die is effected under an increasing reduction in the pressure load while simultaneously pressing in the forming die, and because of the increasing length of the inner profile, the increasing influence of the wall friction between the finished tube or tube profile and the supporting sleeve is compensated for.

More particularly, as the return path increases, the pressure load on the annular die is reduced to such an extent that the sum of the forces resulting from the integrated wall friction between the tube or hollow profile and the supporting sleeve in the region of deformation on the one hand and the pressure load on the annular die on the other hand remains approximately constant. This means that uniform pressure conditions are generated in the respective region of deformation along the entire profile length, which pressure conditions can be optimized.

In another embodiment, the process of producing inner profiles is used for producing splined shaft profiles which are suitable for producing torque transmitting plug-in connections between an inner and an outer splined shaft profile.

According to a further embodiment, the inner profile is produced in the form of a multiple ball track profile which can serve as the outer part of a torque transmitting ball-containing longitudinal displacement unit.

BRIEF DESCRIPTION OF THE DRAWINGS

A preferred embodiment of the invention is illustrated in the drawing and will be described below.

DETAILED DESCRIPTION

Figure 1:
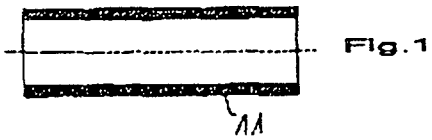
FIG. 1 shows a tubular workpiece in the starting condition.

FIG. 1 shows a tube 11 in the form of a detail inside which an inner profile is to be produced. It is possible, instead of the tube, to use a substantially uniform closed tubular profile. In such a case, the supporting sleeve and the profiled die have to be adapted accordingly.

Figure 2:
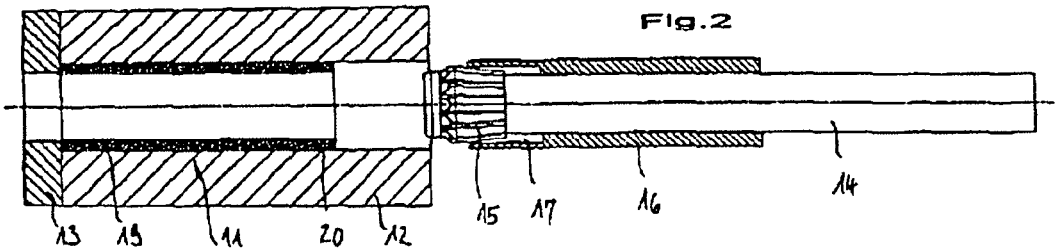
FIG. 2 shows the tube inserted into the supporting sleeve including a profiled die and an annular die before the start of the deformation process.

In FIG. 2, the tube 11 is inserted in a substantially play-free way into a supporting sleeve 12, and, for the purpose of being axially supported, both are jointly positioned on a base plate 13 with a central hole. Said base plate 13 directly supports a first tube end 19. The second rear tube end 20 is free. At a distance from the supporting sleeve 12, there is provided a coaxially arranged die 14 with an attached profiled die 15 for producing an inner profile in the tube 11. On the die 14, there slides an annular die 16 which, at its front end, comprises an inner recess 17 which partially accommodates the profiled die 15.

Figure 3:
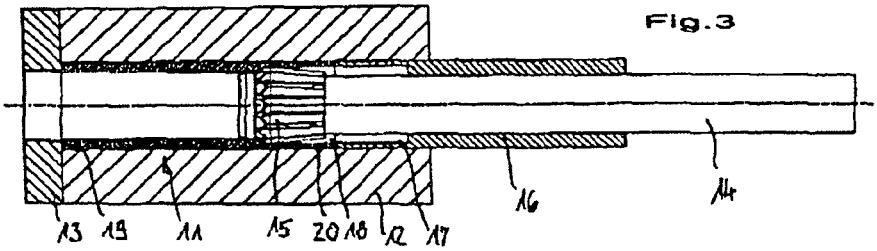
FIG. 3 shows the tube inside the supporting sleeve in an early phase of pressing in the profiled die.

In FIG. 3, the profiled die 15, for the purpose of producing an inner profile 18, has already been partially pressed into the tube 11 from the second tube end 20, In this example, the inner profile 18 is a splined shaft profile. Other profiles are contemplated including a ball track profile for a plunging shaft unit. By proceeding in this way, the front end of the annular die 16 is in contact with the end face of the second tube end 20 from the start. Because of the backward extrusion of the profiled portion, the length of the tube 11 has already increased.

Figure 4:
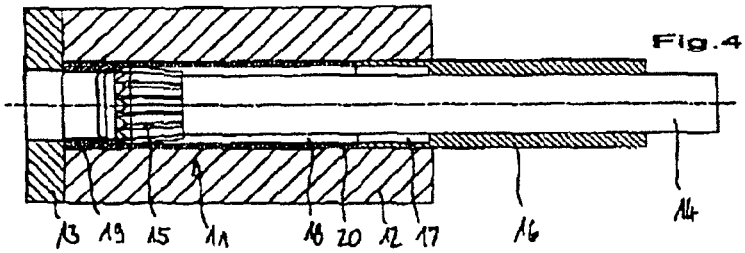
FIG. 4 shows the tube in a later phase of pressing in the profiled die.

FIG. 4 shows the tools and the tube in a later process phase, wherein the profiled die 15, while producing the inner profile 18, has already been largely axially pressed into the tube 11. The pressure-loaded annular die 16 has been further pushed back relative to the supporting sleeve 12.

Figure 5:
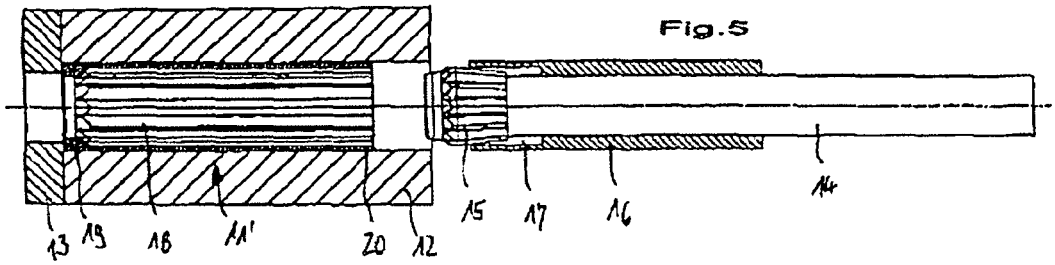
FIG. 5 shows the finish-profiled tube in the supporting sleeve after the profiled die has been withdrawn.

FIG. 5 shows the completed tube 11' while still inside the supporting sleeve 12 after the first die 14 with the profiled die 15 and the annular die 16 have been withdrawn from the supporting sleeve 12. As there has been provided the supporting plate 13, the profile cannot be guided as far as the tube end.

It if is the intention to produce a profile which extends along the entire length, the first tube end 19 can be cut off.

Figure 6:
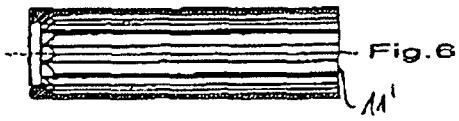
FIG. 6 shows the finished profiled tube according to FIG. 5 in the form of a detail.

FIG. 6 shows the finished profiled tube 11' in the form of a detail. It has already been described that while the profiled die is driven forward in the tube, the pressure load on the annular die 14 escaping towards the right is reduced towards the left with an increasing return path in such a way that the sum of the forces resulting from the integrated wall friction in the deformed region and of the pressure load force applied by the annular die is substantially kept constant.

A tubular workpiece or a hollow-profile-like workpiece 11 with a substantially uniform wall thickness has been inserted into a mould or supporting sleeve 12, wherein both the workpiece 11 and the supporting sleeve 12 are positioned on a base plate 13 for the purpose of being axially supported. A first die 14 with a threaded-on profiled die 15 producing an inner profile 18 have already been axially pressed into the workpiece. The cross-section of the tube or hollow profile has been deformed into the finish-formed workpiece 11' with the inner profile 18. The front end of the annular die 16 is placed on to the upper end of the workpiece 11 and is pressure-loaded upwardly, i.e. it is able to give in the opposite direction to the first die 14 when the die 14 is moved forward downwardly, i.e. in the direction of deformation. To be able to accommodate the profiled die 15 at the beginning of the deformation process, the annular die 16 comprises an inner recess 17 at its front end. Between the finished profile 11' and the mould or supporting sleeve 12, the backward extrusion causes a wall friction which adds up up to the region of deformation at the profiled die 15. With an increasing return path, the pressure load on the annular die 14 is reduced in such a way that the sum of the integrated wall friction at the region of deformation and of the pressure load force can be kept substantially constant.

The invention claimed is:

1. A process of producing an inner profile in a tube or hollow profile comprising:

providing one of a tube or hollow profile having an internal through opening and a constant cross section over the length thereof, inserting the tube or hollow profile into a supporting sleeve, with a first tube end being axially supported;

placing a pressure-loaded annular die on to a second tube end;

pressing a forming die with an outer profile into the tube or hollow profile from the second tube end for producing the inner profile; and allowing a return of the annular die under a pressure load in the opposite direction of that of pressing in the forming die;

wherein the pressure load on the annular die is reduced with an increasing return path.

2. A process according to claim 1, wherein the inner profile is a splined shaft profile.

3. A process according to claim 1, wherein the inner profile is a ball track profile.

4. A process according to claim 1, wherein the second tube end is only radially supported by the sleeve.

5. A process according to claim 1, wherein the supporting sleeve is axially longer than the tube or hollow profile.

6. A process according to claim 1, wherein the annular die retracts during the step of pressing in response to a backward flow of material.

7. A process according to claim 1, wherein the annular die and pressing die are coaxially arranged.

8. A process of producing an inner profile in a tube or hollow profile comprising:

inserting the tube or hollow profile into a supporting sleeve, with a first tube end being axially supported;

placing a pressure-loaded annular die on to a second tube end;

pressing a forming die with an outer profile into the tube or hollow profile from the second tube end for producing the inner profile; and allowing a return of the annular die under a pressure load in the opposite direction of that of pressing in the forming die, wherein the pressure load on the annular die is reduced in such a way that the sum of an integrated wall friction between the tube or hollow profile and the supporting sleeve in the region of deformation, and the pressure load on the annular die remains approximately constant.

9. A process according to claim 8, wherein the inner profile is a splined shaft profile.

10. A process according to claim 8, wherein the inner profile is a ball track profile.

* * * * *